US007299765B1

(12) United States Patent
Phelps

(10) Patent No.: US 7,299,765 B1
(45) Date of Patent: Nov. 27, 2007

(54) SIGNAL SUPPORT ASSEMBLY

(76) Inventor: James Phelps, 9515 Dominican Dr., Miami, FL (US) 33189

( * ) Notice: Subject to any disclaimer, the term of this patent is extended or adjusted under 35 U.S.C. 154(b) by 0 days.

(21) Appl. No.: 11/406,450

(22) Filed: Apr. 18, 2006

Related U.S. Application Data

(60) Provisional application No. 60/672,587, filed on Apr. 19, 2005.

(51) Int. Cl.
*G09F 17/00* (2006.01)
*B63B 21/54* (2006.01)

(52) U.S. Cl. ..... 116/173; 114/221 R

(58) Field of Classification Search ..... 116/28 R, 116/173, 174; 114/221 R
See application file for complete search history.

(56) References Cited

U.S. PATENT DOCUMENTS

| | | | | | |
|---|---|---|---|---|---|
| 389,806 | A | * | 9/1888 | Hale | 116/173 |
| 470,873 | A | * | 3/1892 | Chapman et al. | 40/317 |
| 815,115 | A | | 3/1906 | Pax et al. | |
| 1,153,206 | A | | 9/1915 | Eisenberg | |
| 1,297,578 | A | * | 3/1919 | Lindstaedt | 52/632 |
| 1,305,885 | A | | 6/1919 | Coe | |
| 1,312,426 | A | | 8/1919 | Schmidt | |
| 1,871,667 | A | | 8/1932 | Dalton | |
| 2,441,875 | A | | 5/1948 | Faber | |
| 2,452,842 | A | | 11/1948 | Davis | |
| 2,702,910 | A | * | 3/1955 | Ake | 416/71 |
| 2,748,745 | A | * | 6/1956 | Pobanz et al. | 116/173 |
| 3,105,459 | A | | 10/1963 | Conn | |
| 3,225,734 | A | | 12/1965 | Bule | |
| 3,675,616 | A | | 7/1972 | McInnis | |
| 3,678,456 | A | | 7/1972 | Gruber | |
| 3,987,807 | A | * | 10/1976 | Varnell | 135/66 |
| 4,004,539 | A | * | 1/1977 | Wesson | 114/221 R |
| 4,037,554 | A | * | 7/1977 | Foscolo | 114/221 R |
| 4,263,864 | A | * | 4/1981 | Carter et al. | 114/221 R |
| 4,291,432 | A | * | 9/1981 | Cogswell | 15/160 |
| 4,800,834 | A | | 1/1989 | Feng | |
| 4,944,656 | A | | 7/1990 | Feng et al. | |
| 5,005,512 | A | | 4/1991 | Fu | |

(Continued)

FOREIGN PATENT DOCUMENTS

| | | | | |
|---|---|---|---|---|
| DE | 19838272 | A1 | * | 3/2000 |
| EP | 359921 | A1 | * | 3/1990 |
| GB | 2255851 | A | * | 11/1992 |
| JP | 2000172208 | A | * | 6/2000 |

*Primary Examiner*—Alexander R. Smith
(74) *Attorney, Agent, or Firm*—Mayback & Hoffman P.A.; Gregory L. Mayback; Scott D. Smiley

(57) ABSTRACT

A support assembly for a signal such as a signal flag or the like, which is structured for multiple uses by the provision of an end piece removably attached in different operative positions to the distal end of a staff having an elongated configuration of variable length. The multiple uses of the support assembly is due to the end piece comprising a tool, preferably in the form of a hook, such that when the end piece/tool is disposed in at least one of the operative orientations, the staff and end piece/tool can be used as a boat hook assembly. When so used, a shaft structured to support the signal flag thereon may be disposed on the interior of the staff, along with the flag furled thereabout. Another of the operative orientations comprises the flag shaft disposed exteriorly of the staff in an exposed position for display of the signal flag thereon.

18 Claims, 2 Drawing Sheets

U.S. PATENT DOCUMENTS 5,042,419 A 8/1991 Bianco
6,000,414 A * 12/1999 Crusor ..... 135/66
6,155,197 A 12/2000 Stanley
2004/0025778 A1 2/2004 Maki

* cited by examiner

SIGNAL SUPPORT ASSEMBLY

CLAIM OF PRIORITY

The present application is based on and a claim to priority is made under 35 U.S.C. Section 119(e) to provisional patent application currently pending in the U.S. Patent and Trademark Office having Ser. No. 60/672,587 and a filing date of Apr. 19, 2005.

BACKGROUND OF THE INVENTION

1. Field of the Invention

This invention relates to a multipurpose signal flag or like structure support assembly including an end piece configured in the form of a utilitarian tool. Removable connection of the end piece in either of at least two operative orientations defines the use of the support assembly as a boat hook or like tool structure or as a support for the displayed signal flag.

2. Description of the Related Art

While participating in the sport of scuba-diving, skin diving or the like, especially in an open water environment, it is necessary to display an appropriate signal or dive flag in a highly visible manner. Unfortunately, many smaller boats are not normally structured to accomplish sufficient positioning and display of a signal flag of this type in order to provide proper warning of diving activity in a given area. As a result many dive flags are merely connected to some type of float structure and anchored in area of the dive site. While meeting necessary regulatory conditions for display, the dive flag is located in such a low lying position that the observation thereof, especially by individuals traveling in a high speed watercraft, is extremely difficult. As a result, numerous accidents and significant injury, including death, is an all too frequent result. Accordingly, it is well recognized that the effective exposure and display of a dive flag or like signal flag in an occupied water area is becoming increasing important. Such active display is rendered even more critical due to the increased popularity of "jet boats" or "jet skis" commonly traveling at extremely high speeds.

In order to overcome problems and disadvantages of the type set forth above numerous devices have been developed and are possibly commercially available which serve to actively display a dive flag or like structure in a manner which is clearly observable even from a great distance. However, such flag displays or supporting devices are generally difficult to store because of an extended length and/or because of the rigidity or other structural features of conventional support assemblies dive or signal flags. As a result, the use of fixed, elongated support assemblies for dive and signal flags has dwindled, in that many types of water craft have relatively limited storage space which is not readily adaptable for the positioning or storage of elongated flag poles.

One solution to the problem has been the innovation of selectively extendable flag supports, which may be selectively disposed in either an outwardly extended or inwardly collapsed position. In the collapsed position, storage is facilitated even on the smallest marine craft. However, due to well recognized space limitations even on some of the larger boats, the storage of extra, relatively infrequently used devices becomes a nuisance. As a result dive flags or other signal flags specifically adapted for use on a marine craft are not adequately used or effectively displayed, when used.

As set forth above, various utilitarian structures, implements, tools, etc. are specifically adapted for use on boats of various sizes. Perhaps the most common of such implements is the conventions boat hook assembly. Typically, the boat hook includes an elongated wooden or other appropriate material pole or shaft having a hook-like structure disposed on the end thereof. In use, the boat hook is capable of retrieving articles purposely or inadvertently disposed in the water. The boat hook is also capable of retrieving and passing lines to others aboard the watercraft or to individuals on the docks, so as to facilitate the docking or mooring of the craft. As with many other implements, the storage of boat hooks may be inconvenient due to their size and the rigidity of the material from which they are formed. However, their frequent use typically overrides such inconveniences thereby increasing their presence on watercraft of all sizes.

Accordingly, one solution to the problems and disadvantages of the type set forth above would be the combining of a dive flag and a useful tool or implement such as, but not limited to, a boat hook assembly. Such a proposed structure should be capable of being selectively disposed in either a collapsed or displayed orientation. Moreover, the structuring thereof should be such as to easily convert the proposed dive flag support structure into at least one other useful implement. Further, such a proposed assembly should be capable of displaying and/or storing a dive or like signal flag in an effective and efficient manner. Also, because the proposed signal support assembly could be converted into a tool, its usefulness would most certainly be increased while distinguishing it from either the conventional boat hook or signal flag support structure as known and commonly used in the marine industry. Additionally, such a product should be capable of effectively deploying the flag at an elevated location, preferably above the tallest structure on the boat in compliance with marine regulations.

SUMMARY OF THE INVENTION

The present invention is directed to a support assembly for a signal flag or other type flag which is structured for increased versatility by being able to perform functions other than that of a support for a signal flag or the like. Moreover, multiple use features of the signal support assembly of the present invention is facilitated by the inclusion of a plurality of cooperatively structured components, at least one of which may be selectively disposed into different operative orientations such that the support assembly is capable of at least one useful purpose or function, other than serving as the support for the signal flag.

More specifically, the support assembly of the present invention comprises a staff including a distal end and a proximal end. In addition, the staff preferably includes a variable, elongated configuration facilitated by a plurality of telescopically interconnected staff segments collectively disposable in either a stored, collapsed position or an elongated, extended position. Moreover, the interior of the staff, as well as the plurality of staff segments are at least partially hollow along their respective lengths. Therefore, the plurality staff segments are capable of being concentrically disposed relative to one another, thereby allowing the staff to assume a significantly reduced length, when in the aforementioned collapsed, stored position.

The support assembly of the present invention further comprises an end piece which is removably connected to the distal end of the shaft. Such a removable connection is accomplished by having the opposite ends, or other portions of the end piece, being removably connected to the distal end. As such, the end piece may be connected to the distal end of the shaft in any one of a plurality of operative orientations. Accordingly, the operative orientation of the end piece relative to the distal end at least partially determines the use of the support assembly.

An elongated shaft is secured to the end piece and extends outwardly there from. The shaft is disposed, dimensioned and configured to support a signal flag or like structure thereon, in either a stored position or an exposed, displayed position. The stored position of the flag includes it being rolled or furled about the shaft in substantially covering relation to at least a majority of the length of the shaft. IN this manner, the flag is protected form wind and other damages while traveling, and ensures that it not be lost or forgotten. In contrast, the exposed position of the flag is assumed when it is intended to display the signal flag as intended. Therefore, the signal flag is adaptable for use as a dive flag of the type intended for display in the area of divers, so as to warn surrounding marine craft that one or more individuals are in the water, with the telescoping support assembly ensuring that the flag is deployed above the highest structure on the boat in a manner which complies with marine regulations.

However, structural and operative features of the support assembly of the present invention include the structuring of the end piece to include a tool useful to perform at least one function at least partially unrelated to the display or support of the signal flag. More specifically, one preferred embodiment of the present invention includes tool being in the form of a hook like structure. In so doing, the end piece/tool can be selectively disposed in at least one of the aforementioned operative orientations wherein the end piece/tool, in combination with the staff, defines a boat hook assembly. As is well-known in the area of recreational marine craft, boat hooks are a common implement used on different types of watercraft for a variety of purposes. Therefore, since the use of the signal support assembly as an effective support for a signal or dive flag is a relatively infrequent occurrence, the ability to convert the signal support assembly into a useful implement or tool, such as a boat hook assembly, has significant and distinct advantages. Furthermore, since the tool will generally always be present on the boat to perform its useful functions, an operator is always certain to have the dive flag with them without risk of it being forgotten or lost.

Further structural and operative features of the various preferred embodiments of the signal support assembly of the present invention is the ability to efficiently position the shaft and flag into a stored position. The stored position is more specifically described as the disposition of the shaft in a concealed location on the interior of at least a portion of the staff. This stored, concealed position of the shaft and flag is assumed when the support assembly is intended to be used as a boat hook assembly or alternatively when the entire support assembly is intended to be stored. Further, the relative dimensions and configurations of the shaft, flag and staff, including the various staff segments are such that the staff may be disposed in its collapsed position with the shaft and signal flag disposed on the interior thereof to further facilitate storage in an area of reduced size.

Therefore, the signal support assembly of the present invention accomplishes the multi-purpose function of serving as a stable and reliable and tall support for a flag, such as a dive flag, while being easily converted into a useful tool capable of performing a variety of different functions in the environment of a marine craft. Further, the support assembly is capable of being easily converted and conveniently stored in an area of reduced size when not in use.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying drawings, the present invention is directed to a support assembly generally indicated as 10 for a signal flag, such as a dive flag or like signal device generally indicated as 12. With primary reference to FIG. 1, the support assembly 10 includes a staff generally indicated as 14 capable of assuming a variable longitudinal dimension, such as a fully extended position as demonstrated in FIG. 1 or a collapsed position for storage, as demonstrated in FIG. 2. The selectively variable length of the staff 14 is accomplished by a plurality of staff segments, 15, 16 and 17, cooperatively dimensioned and structured to be movably and telescopically interconnected to one another.

Figure 1:
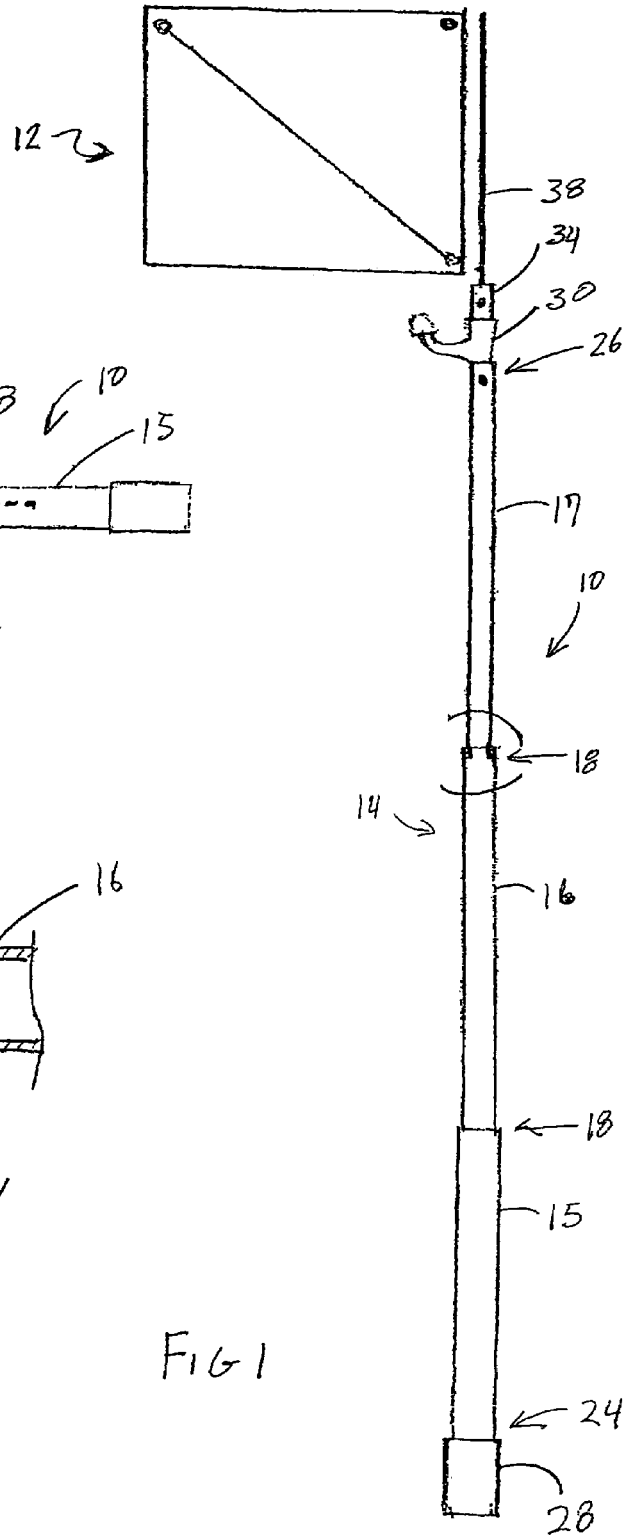
FIG. 1 is front view of a preferred embodiment of a signal support assembly of the present invention in an extended, position for display of a signal flag thereon.

Accordingly, in the fully extended position of FIG. 1, corresponding end portions of the staff segments 15 through 17 come into registry with one another at junctions, generally indicated as 18. Additional structural features facilitate the at least temporary "locking" of the segments 15 through 17 in their extended position. These additional structural features may include a somewhat conventional "twist lock" structure. As such, relative orientation of adjacent, interconnected staff segments 15 through 17 will cause a frictional engagement there between at the corresponding junctions 18, sufficient to maintain the segments 15 through 17 in their extended position.

Figure 2:
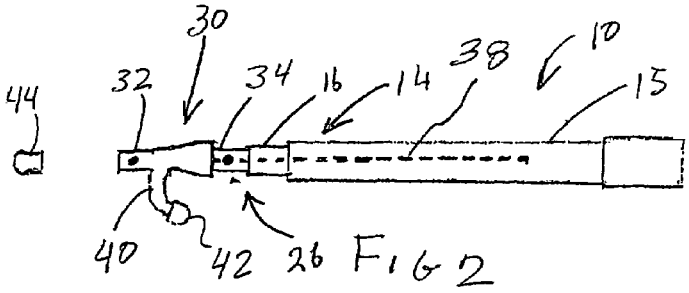
FIG. 2 is a side view in partially exploded form and phantom of the preferred embodiment of FIG. 1 in a collapsed position and wherein the assembly is converted for use as a utilitarian tool or implement.
Figure 4:
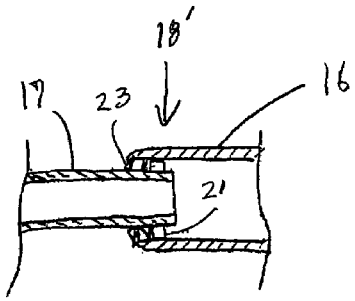
FIG. 4 is a sectional view in partial cut-away of one preferred embodiment structured to removably interconnect and maintain staff segments of the staff of the embodiment of FIGS. 1 and 2 in an extended position.

An alternative embodiment is disposed in FIG. 4, wherein the junction 18' comprises an interior bushing member or like structure 21 mounted on one inner end of the staff segment 17. The bushing 21 is dimensioned and configured to frictionally engagement interior surfaces of the corresponding end of the staff segment 16 as well as to engage an interior stop member 23. Accordingly, each of the adjacent, inner connected staff segments 15 through 17 are prevented from becoming detached from one another. The additional preferred embodiment of FIG. 4 is also capable of temporarily locking adjacent ones of the staff segments 15 through 17 in their outwardly extended position due to the frictional engagement of the bushing members 21 with corresponding tapered or otherwise structured interior surface portions provided at the junctions 18'. As set forth above, the telescopic interconnection of the staff segments 15 through 17 further allows the staff 14 to be collapsed into a stored position as represented in FIG. 2. In this position, each of the staff segments are disposed in concentric relation to one another, wherein the larger staff segment 15, having the greatest interior diameter, will house and concentrically surround the additional staff segments 16 and 17.

Additional structural and operative features of the support assembly 10 include the staff 14 having a proximal end generally indicated as 24 and a distal end generally indicated as 26. A handle or like base portion 28 is secured to the proximal end 24 and is preferably dimensioned and configured to facilitate the mounting or positioning of the staff 14 in a fishing rod holder or like structure of the type commonly found on many different types of marine craft. Accordingly, the staff 14 can be mounted in an upwardly or outwardly extended position where the dive or signal flag 12 is readily observable and thereby provides adequate and meaningful warning to the surrounding marine craft that divers or swimmers are in the water.

Another feature of the signal support assembly of the present invention, which adds to its versatility as well as clearly distinguishes it from the signal flag supporting devices which are conventionally known, is the provision of an end piece generally indicated as 30. The end piece 30 is removably connected to the distal end 26 in any of a plurality of different operative orientations. More specifically, in at least one preferred embodiment of the present invention, the end piece 30 comprises opposite ends 32 and 34 each of which are cooperatively structured with the distal end 26 so as to be removably connectable thereto. The removable connection of the end piece 30 to the distal end 26 may be accomplished by a variety of different types of connectors such as a spring loaded or spring biased connector pins, bayonet connector structures, etc, secured to either the end piece 30 or the distal end 26. It is emphasized that other devices, such as a push pin, cotter-type pin structure or the like may be disposed in interconnecting relation between the distal end 26 and the end piece 30 so as to accomplish efficient and effective removable connection there between.

In addition, a flag or signal support shaft 38 is connected to the end piece 30 and extends linearly outward from one of the opposite ends, as at 34. The shaft 38 has a sufficient length and overall structure to support the signal flag or like flag structure 12, such as by being disposed within an endmost sleeve, as at 12' of the flag 12. Further, the flag 12, is preferably formed of a flexible cloth, canvas or other applicable natural or synthetic material having sufficient flexibility and/or resiliency to be rolled or "furled" about the length of the shaft 38. Alternatively, the signal flag 12 may be positioned in an exposed, displayed position as demonstrated in both FIGS. 1 and 3. When it is intended to display the signal flag 12, the end piece 30 has one of its opposite ends, as at 32, removably connected to the distal end 26 of the staff 14. As such, the shaft 38 extends linearly outward from the opposite end 34 of the end piece 30 in generally aligned relation to the length of the staff 14. In order to clearly display and expose the signal flag 12, a bracing wire or like member 13 may be interconnected diagonally across at least one face of the flag 12. However, while intended to perform a bracing function, the member 13 should also demonstrate sufficient flexibility to allow the flag 12 to be furled about the length of the shaft 38.

In that the end piece 30 may be removably connected at each of its opposite ends 32 and 34 to the distal end 26 of the staff 14, the end piece 30 may assume either of at least two operative orientations relative to the distal end 26. Also, because the ends 32 and 34 are oppositely disposed, at least two of the aforementioned operative ends may be described as "reversed" operative orientations. As set forth above, when the opposite end 32 is removably connected to the distal end 26, the shaft 38 is located exteriorly of the staff 14 and thereby facilitates the display or exposure of the signal flag 12. In contrast, the opposite end 34 may also be connected to the distal end 26 by a reversed, operative orientation of the end piece 30 for it to assume the position of FIG. 2. In the operative orientation of FIG. 2, the shaft 38 is located on the interior of the staff 14 and more particularly on the interior of an extending along a length of the staff segment 17. The relative interior dimension of the staff segment 17 and that of the shaft 38, even with the flag 12 furled thereabout, is such that the shaft 38 and furled flag 12 may be maintained on the interior of staff segment 17. When the shaft 38 is so disposed on the interior of a portion of the staff 14, the support assembly 10 may assume either the collapsed position of FIG. 2 or it may be fully extended, as demonstrated in FIG. 1.

Yet another structural and operative feature of the present invention is an at least partially configuring and/or structuring of the end piece 30 in the form of a tool. More specifically, the end piece 30 is structured and configured to include a hook-like member 40 connected thereto and extending somewhat transversally outward there from. The end of the hook 40 may be blunted or may include a protective cover 42 thereon, for reasons which will become more apparent hereinafter. Also, when the end 34 is connected to the distal end 26, the end 32 defines the outermost extremity of the assembly 10 and may accordingly be covered by a protective cap or cover 44. It is noted that in the preferred embodiment, those protective caps or covers 42 and 44 may be formed of a resilient material such as rubber so as to provide for gripping and so as to prevent damage to articles in which they come into contact during normal usage of the present invention.

Therefore, when the end piece/tool 30 is disposed in the reversed or operative orientation demonstrated in FIG. 2, from that originally represented in FIG. 1, the end piece/tool 30 is cooperatively structured with the staff 14 so as to define a utilitarian tool or implement preferably, but not necessarily, in the form of a boat hook assembly of the type commonly used on a variety of different marine craft. Naturally, when the end piece/tool 30 is removably connected to the distal end 26, as demonstrated in FIG. 2, the staff 14 may be selectively disposed and maintained in its fully extended position so as to render the resulting boat hook assembly more useful. As is well-known, boat hooks used on a variety of different marine crafts are useful to retrieve objects from the water, transfer lines of the craft to an individual on a dock or mooring station and a variety of other useful purposes.

Figure 3:
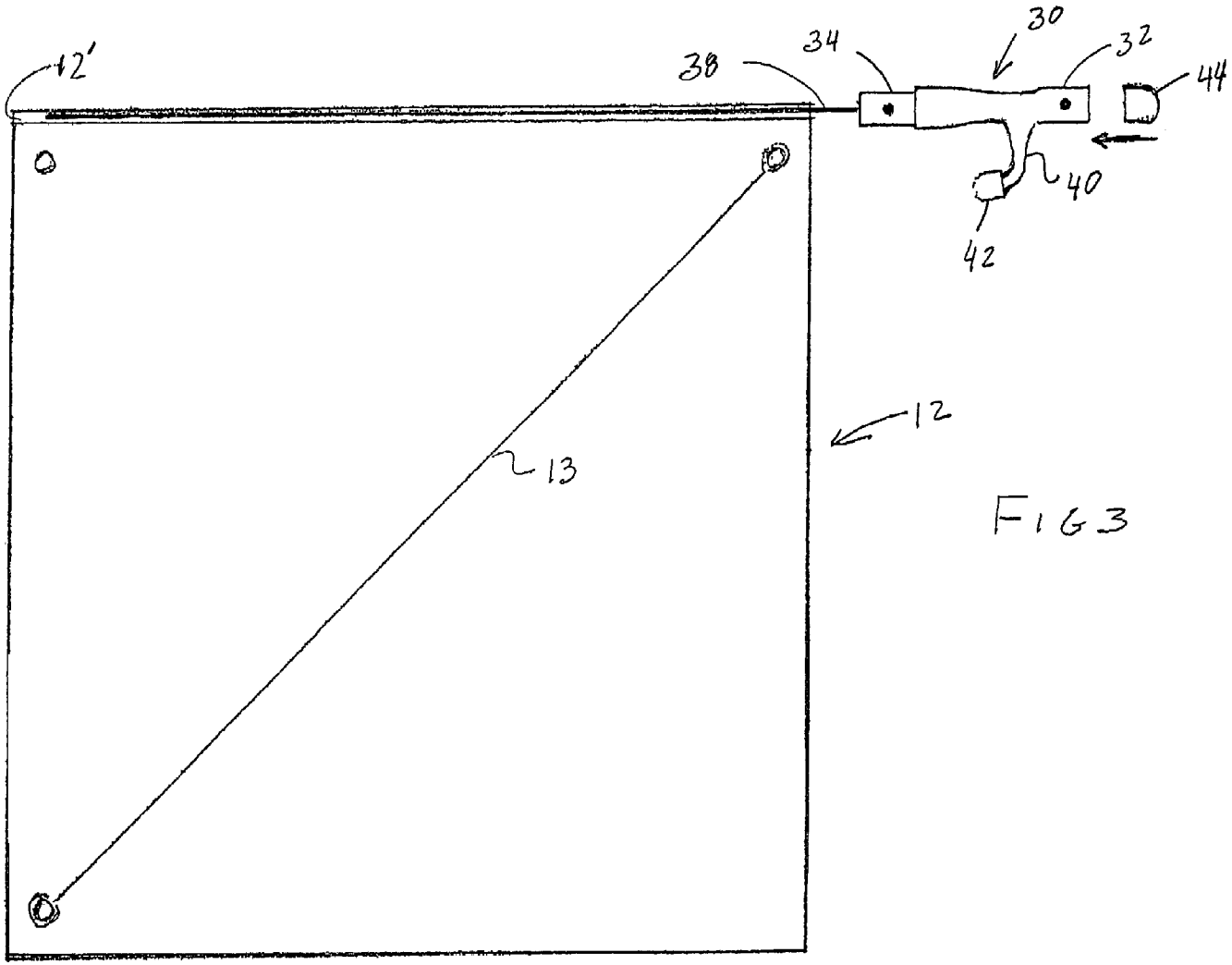
FIG. 3 is a side view in partially exploded form of an end piece of the embodiment of FIGS. 1 and 2 in one of a plurality of operative orientations and being disposed in supporting relation to a signal flag but disconnected from the staff assembly of the embodiment of FIGS. 1 and 2.

When it is desired to display the signal flag 12, the tool piece 30 is again selectively disposed into its other reversed operative orientation as demonstrated in FIGS. 1 and 3. When so disposed the hook or like tool 40, while still present on the end piece 30, is oriented so as to render the use of the support assembly 10 as a boat hook ineffective, if not impossible. However, the disposition of the hook 40 in the out of the way location relative to the distal end 26, as represented in FIGS. 1 and 3, eliminates its interference with the exterior, outwardly extending disposition of the shaft 38 and the display signal flag 12.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A support assembly for a signal device structured for multiple uses, said support assembly comprising:

a staff including a distal end and a proximal end and being structured to assume an elongated configuration, an end piece connected to said distal end and cooperatively structured therewith to assume different operative orientations relative to said distal end, a shaft connected to said end piece and structured to support the signal device in the form of a flag thereon, and one of said operative orientations comprising said shaft disposed in an exposed position and another of said operative positions comprising said shaft disposed in a concealed position, said end piece comprising a tool cooperatively disposed and structured to perform a predetermined function when said end piece is disposed in at least one of said operative orientations, said tool comprising a hook member cooperatively structured with said staff to define a boat hook assembly.

2. A support assembly as recited in claim 1 wherein said end piece is removably connected to said distal end in either of at least two of said operative orientations.

3. A support assembly as recited in claim 2 wherein said two operative orientations are at least partially defined by reversed orientations of said end piece relative to said distal end.

4. A support assembly as recited in claim 3 wherein said end piece comprises oppositely disposed ends each removably connectable to said distal end.

5. A support assembly as recited in claim 1 wherein said end piece is removably connected to said distal end in either of two substantially reversed operative orientations.

6. A support assembly as recited in claim 5 wherein said end piece comprises oppositely disposed ends each removably connectable to said distal end.

7. A support assembly as recited in claim 5 wherein a first of said reversed operative orientations comprises said shaft disposed in an exposed exterior position relative to said staff.

8. A support assembly as recited in claim 7 wherein a second of said reversed operative orientations comprises said shaft disposed interiorly of said staff and in said substantially concealed position.

9. A support assembly as recited in claim 1 wherein said end piece is removably connected to said distal end and selectively disposed in said at least one operative orientation.

10. A support assembly as recited in claim 9 wherein said at least one operative orientation comprises said shaft disposed interiorly of said staff in said substantially concealed position.

11. A support assembly as recited in claim 10 wherein said shaft is dimensioned and configured to have the flag furled thereabout and concurrently disposed interiorly of said staff when said end piece is in said at least one operative orientation.

12. A support assembly as recited in claim 9 wherein said shaft is disposed exteriorly of said staff and structured to support the flag in an open, exposed position when said end piece is removably connected to said distal end in another of said operative positions.

13. A signal support assembly structured for multiple uses, said signal support assembly comprising:

a staff including a distal end and a proximal end and structured to assume an elongated configuration, an end piece removably connected to said distal end in different operative orientations, said end piece comprising a tool structured to perform at least one predetermined function when said end piece is disposed in at least one of said operative orientations, a shaft connected to said end piece and structured to support a flag thereon, and said at least one operative position comprising said shaft disposed interiorly of said staff in a substantially concealed position and another of said operative positions comprising said shaft disposed exteriorly of said staff, said tool comprising a hook member cooperatively structured with said staff to define a boat hook assembly.

14. A signal support assembly as recited in claim 13 wherein said end piece comprises oppositely disposed ends each removably connectable to said distal end.

15. A signal support assembly as recited in claim 13 wherein said staff comprises a plurality of staff segments telescopically connected to one another to define a variable length of said staff.

16. A signal support assembly as recited in claim 13 wherein said end piece is removably connected to said distal end of said staff and selectively disposed in either of two substantially reversed operative orientations on said distal end.

17. A signal support assembly structured for multiple uses, said signal support assembly comprising:

a staff including a distal end and a proximal end and structured to have a variable, elongated configuration, an end piece removably connected to said distal end and cooperatively structured to assume at least two operative orientations relative to said distal end, a shaft connected to said end piece and structured to support a flag thereof, said end piece comprising a tool structured to include a hook member and cooperatively structured with said staff to define a boat hook assembly, when said end piece is disposed in at least one of said two operative orientations, and another of said two operative orientations comprising said shaft and the flag disposed exteriorly of said staff in an exposed position.

18. A signal support assembly as recited in claim 17 wherein said end piece comprises oppositely disposed ends each removably connectable to said distal end to facilitate disposition of said end piece in either of said two operative orientations.

* * * * *